United States Patent [19]

Bohmer

[11] Patent Number: 4,511,270

[45] Date of Patent: Apr. 16, 1985

[54] APPARATUS FOR LIFTING PRINT AND CORRECTION RIBBONS IN TYPEWRITERS OR LIKE MACHINES

[75] Inventor: Christian Bohmer, Nuremberg, Fed. Rep. of Germany

[73] Assignee: Triumph-Adler A.G. fur Buro- und Informationstechnik, Nuremberg, Fed. Rep. of Germany

[21] Appl. No.: 509,336

[22] Filed: Jun. 30, 1983

[30] Foreign Application Priority Data

Jul. 24, 1982 [DE] Fed. Rep. of Germany ..... 3227714

[51] Int. Cl.[3] ..... B41J 35/23; B41J 29/36

[52] U.S. Cl. ..... 400/214; 400/697.1; 400/236.1

[58] Field of Search ..... 400/214, 236.1, 697, 400/697.1, 211, 212

[56] References Cited

U.S. PATENT DOCUMENTS 3,432,022 3/1969 Priebs ..... 400/214

4,401,395 8/1983 Kurachi et al. ..... 400/697.1

FOREIGN PATENT DOCUMENTS 38215 10/1981 European Pat. Off. ..... 400/697.1

OTHER PUBLICATIONS

J. H. Meier et al., "Multiple Ribbon Cartridge Color Printer", *IBM Technical Disclosure Bulletin,* vol. 22, No. 10, pp. 4481–4482, Mar. 1980.

*Primary Examiner*—Edgar S. Burr

*Assistant Examiner*—David A. Wiecking

*Attorney, Agent, or Firm*—Joseph R. Spalla

[57] ABSTRACT

Apparatus for lifting print and correction ribbons in typewriters or printers having a bidirectional motor for driving a lift lever coupled to lift, according to the direction of rotation, either the print or correction ribbon, as required. In order to be able to use a relatively weak motor, the lifting movements of the lift lever driven directly by the motor are transmitted directly to the print or correction ribbon guides without interconnecting members. Print ribbon feed is implemented by means of camming surfaces on the lift lever operating to feed ribbon during the return movement of the print ribbon to rest position below the printing line.

2 Claims, 2 Drawing Figures

APPARATUS FOR LIFTING PRINT AND CORRECTION RIBBONS IN TYPEWRITERS OR LIKE MACHINES

This invention relates to apparatus for lifting print and correction ribbons in typewriters or like machines.

In modern typewriters ribbons are usually housed in cassettes to facilitate mounting. Such cassettes have been especially successful in typewriters and printers having a movable carrier which runs along the print line. In order to use the ribbon most efficiently, it is known that the print ribbon should be alternately lifted to two different print levels. Modern typewriters are also equipped with correction ribbons which also must be lifted to the print line during a correction procedure. Magnets and/or motors have been used to initiate these lifting movements. In DE-OS No. 29 19 209 there is shown an apparatus with a single bi-directional stepper motor for lifting a print ribbon to different levels opposite the printing line and for lifting a correction ribbon to the printing line as required. In this known apparatus the motor drives cams having associated cam followers which in turn are connected to the print ribbon vibrator or correction ribbon carrier. A disadvantage of this known apparatus is that intermediate spring returnable cam followers between the lift cam and the ribbon guides to be lifted are required. This further requires a relatively powerful motor to lift the train of parts and particularly to store energy in the return springs on the cam followers biased against the cams.

In accordance with the invention a motor driven lift lever acts directly to lift a print ribbon or to lift a correction ribbon as required, according to the direction of the single motor, thereby reducing the parts required and enabling the use of a relatively weak motor as well. In accordance with the invention the print ribbon is fed step-by-step by the lift lever without significant additional loading of the motor.

An object of the invention is to provide a print and correction ribbon lifting mechanism having a minimum of parts operable by a relatively low power motor.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
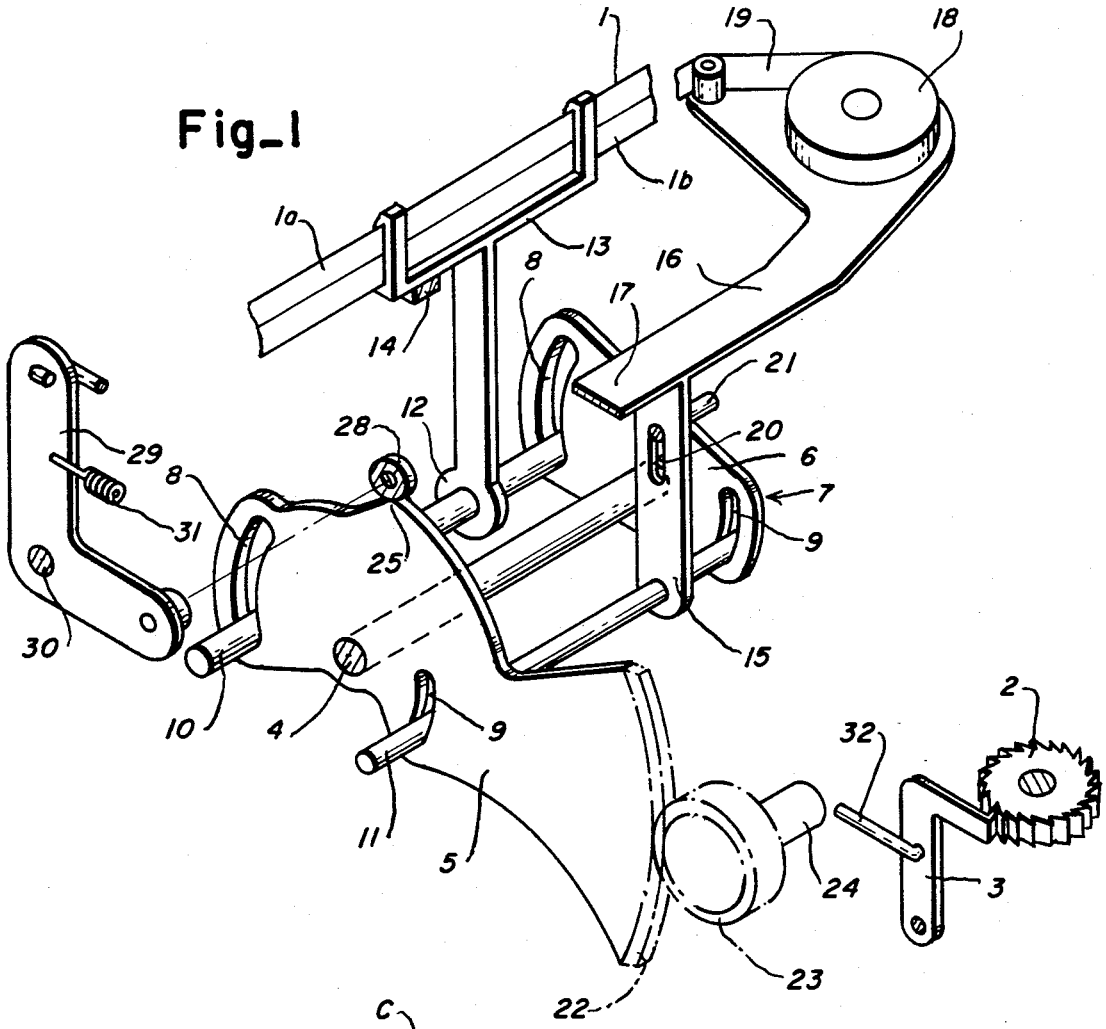
FIG. 1 is a simplified perspective view of the invention.

Referring now to the drawing there is shown in FIG. 1 a length of a print ribbon 1 which extends parallel to and in rest position below a print line. The length of print ribbon 1 shown may be that portion extending exteriorly of a cassette containing supply and take-up spools, the latter being adapted to be coupled to a take-up drive ratchet 2 operable by a feed pawl 3 supported on a print element carriage which also supports the print ribbon supply and take-up spools or a cassette containing these spools.

For the sake of clarity the locations of the parts as illustrated in FIG. 1 do not correspond to their actual positions to enable the invention to be more easily understood. As shown in FIG. 1 lift levers 5 and 6 are secured for rotation with an axle 4 rotatably mounted in a print element carriage. The lift lever assembly generally designated by reference numeral 7 acts as a seesaw about the bearing of axle 4. Each of the lift levers 5 and 6 have circular arc-shaped slots 8 and 9 located forwardly and rearwardly of the axle 4 at different radii from the center of the axle 4. Shafts 10 and 11, parallel to axle 4, extend through the slots 8 and 9 in the lift levers 5 and 6 and are suitably secured against axial movement. As shown in FIG. 1 a ribbon vibrator 13 for supporting and guiding the length of print ribbon 1 is rotatably mounted on the shaft 10 by means of a bearing portion 12. The ribbon vibrator 13 normally rests on a stop 14 which determines the lowered or home position of the print ribbon 1.

Similarly, on the shaft 11 there is mounted a depending leg 15 of a correction ribbon support bridge having rightwardly and leftwardly directed portions 16 and 17, the latter of which is shown in part only. The end of portion 16 rotatably supports a correction ribbon take-up spool 18 which draws correction ribbon 19 from a correction ribbon supply spool on the leftwardly directed portion 17 across the printing line. A stationary pin 21, which is suitably attached to the carriage frame, passes through a slot 20 to guide the movement of the correction tape 19 in a vertical plane and at the same time to establish the lowered, rest or home position of the correction tape 19.

The rearward edge of lift lever 5 is formed with a gear 22 that is engaged with a pinion 23. The pinion 23 is adapted to be driven in two directions via the shaft 24 of a bidirectional motor, (not shown) such as a stepper motor. The top edge of the lift lever 5 is also shaped to define a cam lobe 25 at the end of an arc 27 in the direction of the gear 22. The top edge of the lift lever dips in the opposite direction to form an arc 26 whose radius from the center of axle 4 is less than the radius to arc 27. A cam follower roller 28 is provided on a right angled pull lever 29 which is pivotably mounted, as at 30, on the carrier frame. The pull lever 29 is biased clockwise by a spring 31 which keeps the cam follower 28 in constant contact with the cam lobe 25 or the circular arcs 26 and 27. A rod 32 connects the pull lever 29 to the pawl 3.

Figure 2:
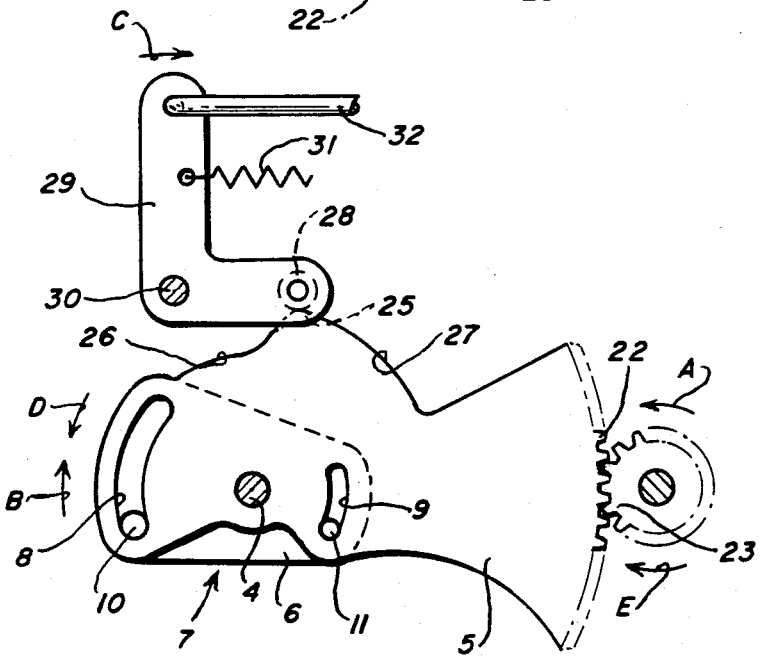
FIG. 2 is a side elevational view of the lift lever assembly.

The function of the apparatus is as follows: During a print sequence the bidirectional motor will be energized to turn the pinion 23 in the direction of arrow A (FIG. 2) thereby to drive the levers 5 and 6 in the direction of arrow B through a predetermined angle programmed into a motor control micro-processor. The swinging movement of the lift lever assembly 7 in the direction of arrow B raises the shaft 10 and the ribbon vibrator 13 to locate, as the case may be, either the band 1*a* or 1*b* of the print ribbon 1 opposite a print line. During this lifting movement shaft 11 retains its position in that slot 9 moves downward and away from shaft 11. Thus, the correction tape 19 remains in its home position.

Also during the swinging movement of the lift lever assembly in the direction of arrow B, the cam lobe 25 travels under the cam follower 28 of the pull lever 29 so that the cam follower 28 now bears against the circular arc 26 of smaller radius than that of arc 27. Thus, the pull lever 29 urged by spring 31 moves clockwise in the direction of arrow C pushing the pawl 3 rearwardly which ratchets idly relative to the ratchet wheel 2. As will be appreciated, the spring 31 aids the motor in this sequence. After an imprint through the lifted print ribbon 1 the motor and pinion are driven in reverse direction back to the home position shown in FIG. 1. The return movement of the print ribbon vibrator 13 is by gravity and is limited by the stop 14. In special cases the return movement of the print ribbon vibrator 13 can be assisted by a spring. The return movement of the lift lever assembly 7 in the direction of arrow D also carries the cam follower 28 back to the height of the cam lobe 25 and rocks the pull lever 29 counterclockwise. This counterclockwise movement of the pull lever 29 pulls the pawl 3 forwardly thereby to turn the ratchet wheel 2 whose rotational movement drives the print ribbon take-up spool so that a fresh portion will be next presented at the print line.

During a correction sequence the pinion is turned by the motor 23 in the direction of the arrow E. Thus the lift lever assembly 7 is swung in the direction of arrow D from its home position. This movement causes shaft 11 in slot 9 to be lifted thereby to lift the correction ribbon support 16 to present the correction ribbon 19 opposite the print line. In this correction sequence the movement of the lift lever assembly 7 has no affect on shaft 10 since circular slot 8 moves away from shaft 10. In the correction sequence the cam follower 28 of the pull lever 29 follows circular arc 27 which is at the same radius from the center as cam lobe 25. As a consequence pull lever 29 is not rocked and the pawl 3 is not moved. After a correction the lift lever assembly 7 is returned to its home position by the rotation of pinion 23 opposite direction E which allows the correction ribbon carrier 15 to also return to its home position so that the upper end of the slot 20 therein rests on the stationary pin 21. If necessary, the return movement of the carrier 15 for the correction tape 19 can be assisted by a return spring.

As can be seen in the drawing and the preceding explanation, direction and degree of the angular movement of the lift lever assembly 7 can be chosen to correspond to the desired function. It is to be noted that the feed movement for the print ribbon 1 is separate from the ribbon lift movement and is operative during return movement of the lift lever assembly 7 only during a print ribbon lift sequence. Thus, a relatively weak motor can be used.

Various modifications are within the scope of this invention. For example, the lift levers 5 and 6 of the assembly 7 might be made identical to simplify manufacturing costs and they can be separately supported on separate bolts instead of a single through axle 4 as shown in FIG. 1. Further in such an arrangement separate short stub shafts instead of through shafts 10 and 11 could be employed with the print ribbon vibrator 13 and the correction ribbon support 15 correspondingly modified for support by the separate short stub shafts. In such an arrangement a clear space is available to locate the bidirectional motor between the lift levers 5 and 6 with a pinion on each end of its shaft 24 for engagement with the geared segment of the identical lift levers. Thus the only connection between the two identical lift levers would be the motor shaft 24. An advantage of this arrangement is that there is space between the two identical lift levers 5 and 6 for other components, e.g., the drive motor of a printwheel.

The invention claimed is:

1. Apparatus for independently lifting print and correction ribbons from a rest position to a print line comprising means including a first liftable shaft carrying a print ribbon for movement to said print line, means including a second liftable shaft carrying a correction ribbon for movement to said print line, lift lever means, means supporting said lift lever means for oscillation about a fixed axis, said lift lever means having arcuate slots located on either side of said fixed axis for supporting said first and second shafts in a home position, and for lifting one or the other of said first and second shafts according to the direction of movement of said lift lever means from said home position, said lift lever means including gear means, a motor driven shaft rotatable from a home position in forward and return direction about said home position and a reverse and return direction about said home position according to a print or a correction ribbon lift sequence, and a pinion connected to said motor shaft and engaged with said gear means for driving said lift lever means.

2. Apparatus as recited in claim 1, including a pivotally mounted pull lever having a roller, said lift lever means having a cam surface, means biasing said pull lever whereby said roller is biased against said cam surface for oscillation thereby during a print ribbon lift sequence, a pawl connected to said pull lever, and a ratchet wheel operable by said pawl during the return of said lift lever means in a print ribbon sequence thereby to feed said print ribbon coupled thereto.

* * * * *